United States Patent [19]

Baldocchi

[11] 3,952,930

[45] Apr. 27, 1976

[54] BELT ATTACHMENT DEVICE FOR HOLSTER OR THE LIKE

[76] Inventor: Archie Baldocchi, San Salvador, El Salvador

[22] Filed: Jan. 24, 1975

[21] Appl. No.: 543,766

[52] U.S. Cl. ..... 224/2 C; 224/5 R; 224/26 R

[51] Int. Cl.[2] ..... F41C 33/04

[58] Field of Search ..... 224/2 C, 2 B, 2 A, 2 D, 224/2 E, 2 F, 5 R, 5 A, 26 R, 26 B, 5 H, 5 E

[56] References Cited

UNITED STATES PATENTS

| | | | |
|---|---|---|---|
| 1,024,653 | 4/1912 | Sargent | 224/5 A |
| 1,166,781 | 1/1916 | Parrish | 224/2 C |
| 3,565,303 | 2/1971 | Kippen | 224/2 B |

*Primary Examiner*—Robert J. Spar
*Assistant Examiner*—Jerold M. Frosbreg
*Attorney, Agent, or Firm*—George B. White

[57] ABSTRACT

A continuous strip one end of which is formed into a semi-rigid or stiff saddle adapted to be placed and pressed over a belt; on the face of one side of this saddle are bristles of the Velcro type and through the other side of the saddle is a mounting hole and a mounting lug around the hole, and in continuation of this side is the strip, a middle portion of which is provided with bristles of the Velcro type on the face facing toward the saddle; the free end of the flexible strip has on the face opposite from the bristled face non-slip rubberized fabric, and terminates in a foam rubber cylinder; the saddle is placed on the belt so that the lug is accessible on the outside and the bristles of the Velcro are between the belt and the top of the trousers of the user; the strip is played around the lower portion of the belt upwardly and then over the top of the trouser and to the inside of the trouser whereby the bristled face of the flexible strip engages with the bristled face of the saddle and the remainder of the strip is along the inside of the top of the trousers.

6 Claims, 4 Drawing Figures

BELT ATTACHMENT DEVICE FOR HOLSTER OR THE LIKE

BACKGROUND OF THE INVENTION

There were previous attempts for certain types of holders attachable to belts for various articles. Applicant is aware of U.S. Pat. No. 3,148,812 for a belt holder on which a stiff portion is placed over the upper edge of a belt; the use of Velcro on surfaces of belts is known as for instance in U.S. Pat. Nos. 3,543,977, and 3,664,560. Applicant also has a related copending application, Ser. No. 490,506 filed July 22, 1974, which is now U.S. Pat. No. 3,894,667.

The primary object of this invention is to provide a wraparound belt attachment where adjacent surfaces of the single strip are firmly held together and also the pressure of the body against the belt contributes to the holding of the attachment on the belt.

DETAILED DESCRIPTION

Figure 1:
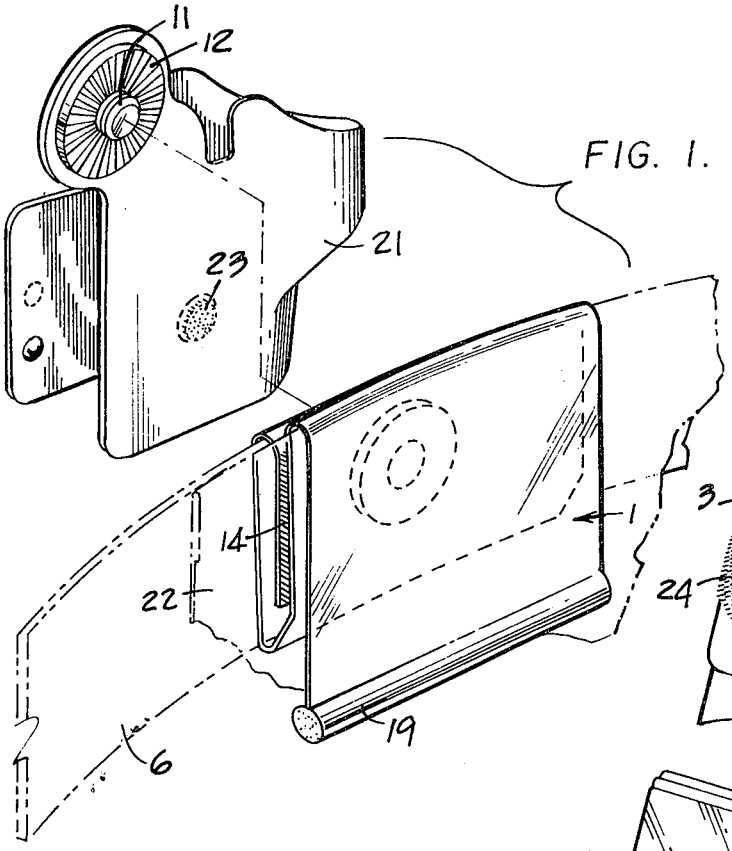
FIG. 1 is a perspective view showing the belt attachment wrapped around the belt and into the trouser top also indicating a pistol holster in relation to the same.

A foldable strip 1 has on one end a saddle 2. The saddle 2 is of substantially U-shaped cross section. One side 3 of the saddle 2 being in continuation of the strip 1 and the other side 4 is bent. The saddle is stiff but pliable material, bendable so it can embrace a belt 6 tightly. For this purpose the connecting joint 7 of the U-shaped cross section is bendable to fit over the upper edge of the belt 6.

Figure 3:
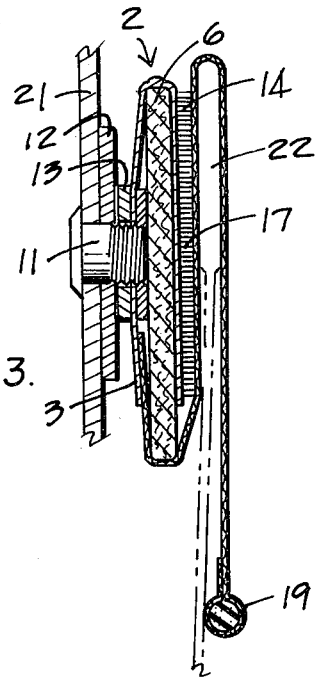
FIG. 3 is a cross-sectional view showing the attachment in position and also the mounting of the holster thereon.

The saddle side 3, hereinafter referred to as the outer saddle side has a flat lug 8 around a central hole 9 which extends through the outer saddle side 3 to permit the inserting of a stud 11 of a mounting plate 12 through the hole 9. The fastening of the stud 11 is accomplished by a flat nut 13 as shown in FIG. 3, on the inner face of the outer saddle side 3. The face of the lug 8 is serrated.

The other side 4 of the saddle, hereinafter referred to as inner saddle side 4, is provided on its exposed surface with adhesive bristles 14 of the Velcro type.

The inner faces of the saddle sides 3 and 4 of the saddle 2 are provided with non-slip surfaces such as ribs or dots or the like or being rubberized.

The middle portion 16 of the strip 1 extends in continuation of the outer saddle side 3 and is provided on its inner face with Velcro-type bristles 17. The portion 18 of the strip 1 between the middle portion 16 and the free end thereof is provided on its exposed face with suitable non-slip surface such as non-slip waffle or similar design. The same type of non-slip surface is provided also on the inside face of the portion 18.

On the free end of the strip 1 is a cylindrical bar preferably made of sponge rubber or other compressible material.

In operation the nut 13 is inserted under the hole 9 and the stud 11 is screwed into the nut tightly so as to hold the holster 21 in adjusted position. The saddle is then placed over the upper edge of the belt 6; then the middle portion 16 of the strip 1 is played over the lower edge of the belt 6 and extended upwardly so that it is wrapped around the belt 6 and the bristles 17 engage the bristles 14 of the inner saddle side 4 so as to hold the strip tightly wound around the belt 6. The remaining portion of the strip is then placed over the top of the trouser or pants 22 as shown in FIG. 3 and is extended between the body of the wearer of the belt 6 and the trouser 22 so as to further firmly secure the holder in position.

The saddle 2 could be used by itself for certain applications without the remaining parts of the strip 1, by clamping the saddle, constructed in accordance with the herein disclosure, over the top edge of a belt.

Figure 4:
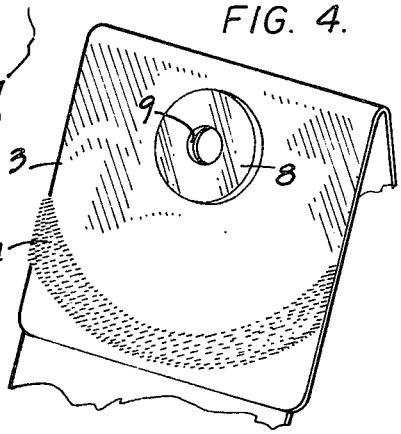
FIG. 4 is a fragmental perspective view of a modified form.
Figure 2:
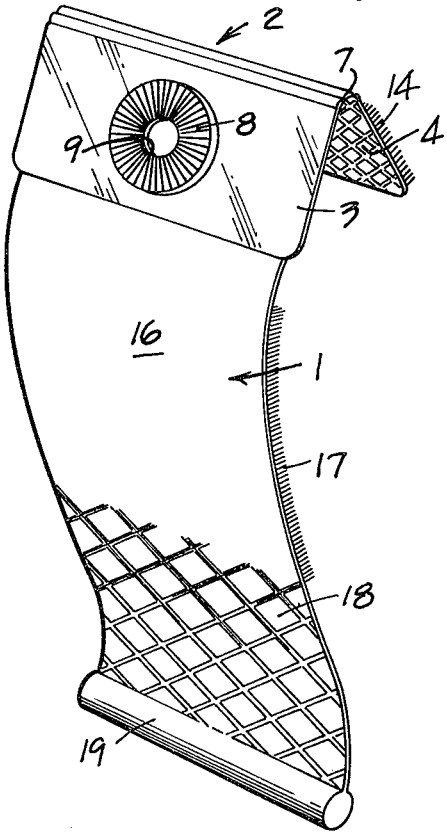
FIG. 2 is a perspective view of the strip of material and the entire belt unwound.

In the modified form shown in FIG. 4, the face of the flat lug 8 is smooth and the mounting plate 1 on the holster 21 is also smooth, so as to allow free pivoting of the holster 21 about the stud 11 to a selected angle. A button 23 shown in broken lines on the side of the holster 21 is engageable with an arcuate strip 24 on the outer face of the outer saddle side 3. The radius of the arc of the strip 24 about the center of the hole 9 is equal to the distance of the button 23 from the center of the stud 11. The interlockable button 23 and the strip 24 are preferably provided with interlocking bristles of the Velcro type. It is intended that the term Velcro-type as herein used, include other interlocking bristles such as so called Hedlok-2.

The herein described holder is flexible and foldable and securely holds a holster or the like; it can be quickly and positively secured in place without clamps or screws or snaps or other such securing devices. The holder is simple, economical, positive in operation and emminently adapted for its purpose.

I claim:

1. A holder attachment attached to a belt and belt supported garment for holding a holster and the like including, a saddle of semi-flexible material being of generally U-shaped cross-section, an inner saddle side and an outer saddle side being connected by a flexible joint whereby said sides can be pressed over the upper edge of a belt, mounting means on the outer saddle side for attachment of the holster thereto, releasable adhesive means on the exposed face of the inner saddle side, a flexible middle strip portion extending as a continuation of the outer saddle side for encircling the belt, an end portion of said strip, releasable adhesive means on the inner face of the middle strip portion at such distance from said outer saddle side that when said middle portion is wrapped around said belt it releasably engages said releasable adhesive means on the exposed face of the inner saddle side, and a portion between said middle strip portion and the end of said strip having a non-slip surface, wherein said end portion is insertable over the edge of the belt supported garment between the wearer's body and the belt.

2. The holder attachment specified in claim 1, and the under faces of the saddle sides inside said U-shaped cross section being provided with non-slip surfaces.

3. The belt attachment specified in claim 1, and, a compressible enlargement on the free end of said strip.

4. The belt holder attachment specified in claim 1, and said releasable adhesive means being coacting bristles of the Velcro type.

5. The holder attachment for a belt specified in claim 1, and said mounting means including a pivot connection for said holster on the outer saddle side, a locking element on the outer face of the outer saddle side, and a locking member on the holster capable of interlocking with said locking element at will.

6. The invention specified in claim 5, and said locking element and said locking member including coacting bristles of the Velcro type.

* * * * *